US007114724B2

(12) United States Patent
Ritzer et al.

(10) Patent No.: US 7,114,724 B2
(45) Date of Patent: Oct. 3, 2006

(54) COMBINATION 3 CARD POKER-BACCARAT GAMING METHOD AND APPARATUS

(76) Inventors: Sandy A. Ritzer, 406 Union Hill Rd., Englishtown, NJ (US) 07726; Andrew J. Ritzer, 406 Union Hill Rd., Englishtown, NJ (US) 07726; Matthew P. Ritzer, 406 Union Hill Rd., Englishtown, NJ (US) 07726

( * ) Notice: Subject to any disclaimer, the term of this patent is extended or adjusted under 35 U.S.C. 154(b) by 28 days.

(21) Appl. No.: 10/880,476

(22) Filed: Jul. 1, 2004

(65) Prior Publication Data

US 2006/0001214 A1 Jan. 5, 2006

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS

| | | | | | |
|---|---|---|---|---|---|
| 3,998,462 | A * | 12/1976 | Goott | 273/274 |
| 4,651,997 | A * | 3/1987 | Wood | 273/274 |
| 5,265,882 | A * | 11/1993 | Malek | 273/292 |
| 5,328,189 | A * | 7/1994 | Malek | 273/292 |
| 5,395,120 | A * | 3/1995 | Malek | 273/292 |
| 5,397,128 | A * | 3/1995 | Hesse et al. | 273/292 |
| 5,431,407 | A * | 7/1995 | Hofberg et al. | 273/292 |
| 5,660,393 | A * | 8/1997 | Dreger | 273/292 |
| 5,690,337 | A * | 11/1997 | Somma et al. | 273/309 |
| 5,868,392 | A * | 2/1999 | Kraft | 273/292 |
| 6,098,984 | A * | 8/2000 | Moore, Jr. | 273/292 |
| 6,102,402 | A * | 8/2000 | Scott et al. | 273/292 |
| 6,379,245 | B1 * | 4/2002 | De Keller | 463/13 |
| 6,517,072 | B1 * | 2/2003 | McInerney | 273/236 |
| 6,561,897 | B1 * | 5/2003 | Bourbour et al. | 463/13 |
| 6,609,711 | B1 * | 8/2003 | Campbell | 273/274 |
| 6,676,128 | B1 * | 1/2004 | Wolf | 273/292 |
| 6,733,012 | B1 * | 5/2004 | Bui et al. | 273/292 |
| 6,913,531 | B1 * | 7/2005 | Yoseloff | 463/13 |
| 6,955,599 | B1 * | 10/2005 | Bourbour et al. | 463/13 |
| 2002/0113371 | A1 * | 8/2002 | Snow | 273/292 |
| 2003/0042679 | A1 * | 3/2003 | Snow | 273/292 |
| 2004/0041346 | A1 * | 3/2004 | Snow | 273/292 |
| 2004/0056418 | A1 * | 3/2004 | Wirth | 273/274 |
| 2004/0056419 | A1 * | 3/2004 | Wirth | 273/274 |
| 2005/0029741 | A1 * | 2/2005 | Ollington | 273/274 |
| 2005/0040601 | A1 * | 2/2005 | Yoseloff et al. | 273/292 |
| 2005/0082755 | A1 * | 4/2005 | Snow | 273/273 |
| 2005/0085287 | A1 * | 4/2005 | Sines | 463/13 |

OTHER PUBLICATIONS

John Scarne, Scarne's Encyclopedia of Games, 1973, p. 26.*

* cited by examiner

*Primary Examiner*—Eugene Kim
*Assistant Examiner*—Dolores R. Collins
(74) *Attorney, Agent, or Firm*—Charles I. Brodsky

(57) ABSTRACT

A casino gambling card table game in which a player may bet that a next card dealt would provide a selected poker hand and/or a winning baccarat hand.

17 Claims, 7 Drawing Sheets

FIG-1
A.
1.
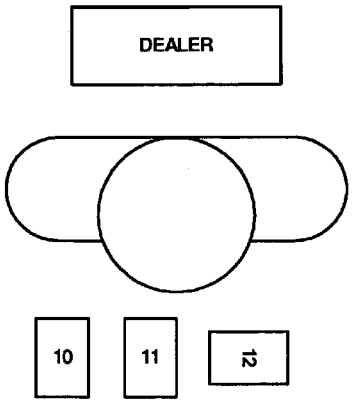
Gaming Apparatus
A1. Dealer position- consisting of and limited to 3 playing card placements for two succesive rounds of play in a game.
A2. Player Position- consisting of an ante wager placement, seven betting rectangles and three playing card placements.
2.
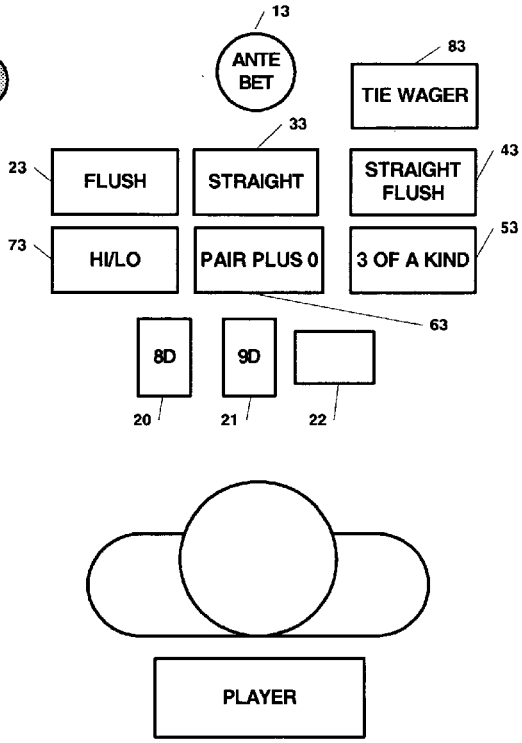

B.
Each Player in turn is dealt one card, face down
1.
Each player places an ante bet to be determined by the house.
2.
DEALER
ANTE BET
13
TIE WAGER
83
FLUSH
23
STRAIGHT
33
STRAIGHT FLUSH
43
HI/LO
73
PAIR PLUS 0
63
3 OF A KIND
53
90
PLAYER 1
PLAYER 2
PLAYER 3

DEALER
5.
After each player receivessecond card dealt face down, the dealer than receives his second card, face down
3.
Dealer receives first card face down
91
93
B.
4.
Each player in turn is dealt one card, face down
13
ANTE BET
Tie Wager
Straight Flush
3 of a Kind
Straight
Pair plus 0
Flush
HI/LO
90
92
PLAYER 1
PLAYER 2
PLAYER 3

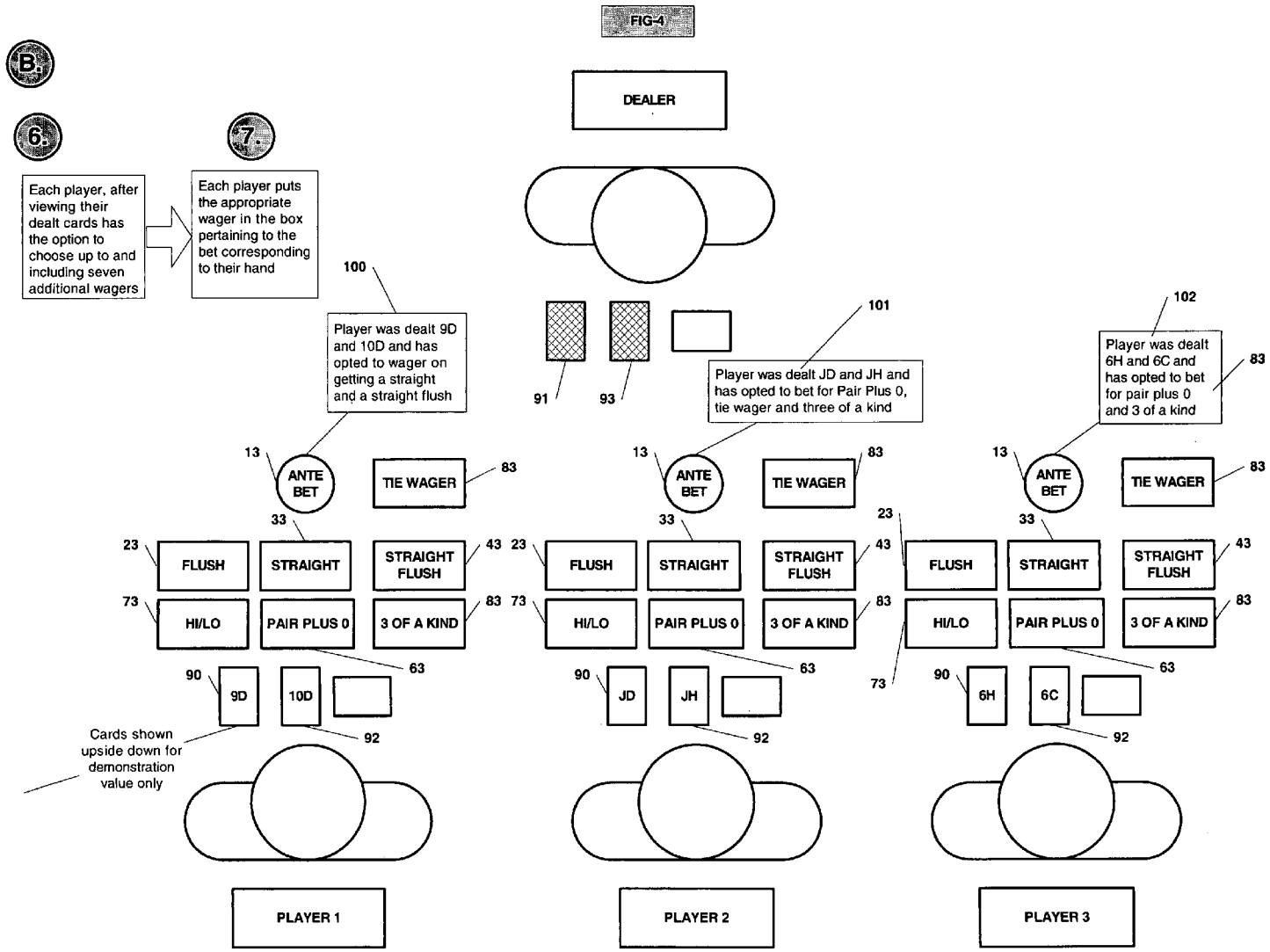
FIG-4
DEALER
PLAYER 1
PLAYER 2
PLAYER 3
ANTE BET
TIE WAGER
STRAIGHT FLUSH
3 OF A KIND
STRAIGHT
PAIR PLUS 0
FLUSH
HI/LO
9D
10D
JD
JH
6H
6C
Player was dealt 9D and 10D and has opted to wager on getting a straight and a straight flush
Player was dealt JD and JH and has opted to bet for Pair Plus 0, tie wager and three of a kind
Player was dealt 6H and 6C and has opted to bet for pair plus 0 and 3 of a kind
Each player, after viewing their dealt cards has the option to choose up to and including seven additional wagers
Each player puts the appropriate wager in the box pertaining to the bet corresponding to their hand
Cards shown upside down for demonstration value only
B.
6.
7.
100
101
102
91
93
90
92
13
23
33
43
63
73
83

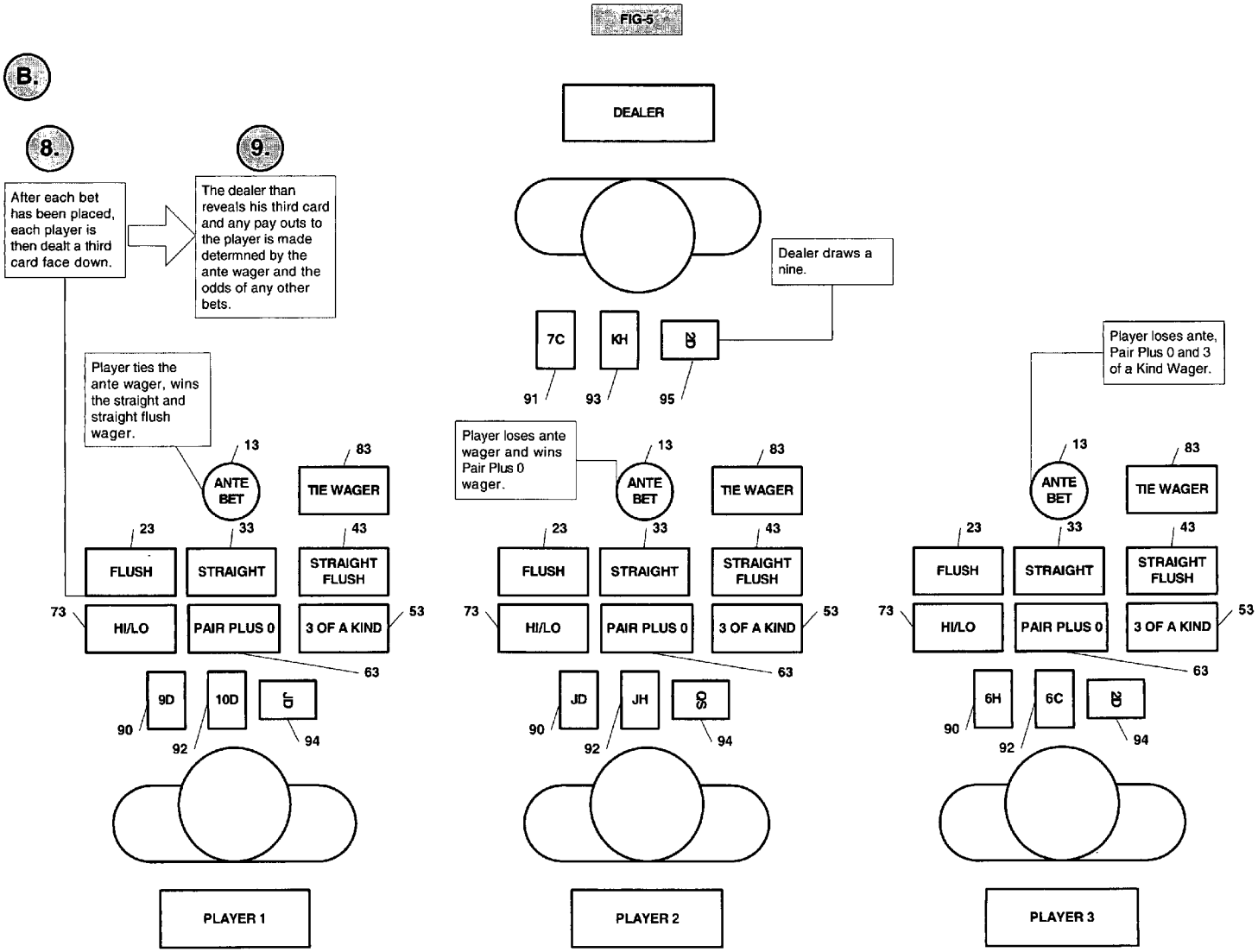
FIG-5
B.
8.
After each bet has been placed, each player is then dealt a third card face down.
9.
The dealer than reveals his third card and any pay outs to the player is made determned by the ante wager and the odds of any other bets.
DEALER
7C
KH
2D
91
93
95
Dealer draws a nine.
Player ties the ante wager, wins the straight and straight flush wager.
Player loses ante wager and wins Pair Plus 0 wager.
Player loses ante, Pair Plus 0 and 3 of a Kind Wager.
ANTE BET
TIE WAGER
STRAIGHT FLUSH
3 OF A KIND
FLUSH
STRAIGHT
PAIR PLUS 0
HI/LO
13
33
43
53
63
23
73
83
9D
10D
QH
90
92
94
JD
JH
QS
6H
6C
2D
PLAYER 1
PLAYER 2
PLAYER 3

COMBINATION 3 CARD POKER-BACCARAT GAMING METHOD AND APPARATUS

CROSS-REFERENCE TO RELATED APPLICATIONS

NONE

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

NOT APPLICABLE

BACKGROUND OF THE INVENTION

1. Field of the Invention

This invention relates to casino gaming apparatus, in general, and to a casino gambling card table game, in particular.

2. Description of the Related Art

As is well known in the casino gaming industry, one of the most popular card table gambling games is 3 card poker in which a player attempts to obtain a higher valued poker hand than the dealer. As will also be appreciated, one of the most raucous of the card table gambling games is baccarat, where it is common for a player to vocally exhort the dealing of a winning card to his/her hand, and a vociferous rooting of a losing card to the Bank so as to attain the objective of having a card total closer to "nine" than the Bank. As will become clear from the following description, the present invention combines features of both 3 card poker and baccarat in making the combined game demonstrative in its play, while at the same time providing a multitude of betting options; as will be seen, this gives the combined game a flavor closer to that of craps, where others than the shooter are able to place individual bets on each roll of the dice. As in both 3 card poker and baccarat, the combined card game of the invention utilizes a standard 52 card deck (without jokers)—and as in baccarat, aces count as "one" and tens, jacks, queens, and kings count as "zero".

As distinct from the commonly played 3 card poker, however, cards may be drawn and/or options selected based on the cards to be dealt rather than just to bet on cards already received. In such manner, a player becomes actively involved in each deal, and involves a certain degree of thought throughout. Having to make decisions concerning a series of bets in any one game makes the play more varied than baccarat, and thus more enjoyable to the participant and more attractive to the casino as well. All that will be seen to be required in its play are the calculations of the odds to be offered by the casino for any bet to be paid (which can be determined by mathematical analysis). Once such odds are set, all that is needed is the standard deck, a table, a game design overlay to sit 6 or 7 players, and the participants with their betting chips themselves.

SUMMARY OF THE INVENTION

As will become clear from the following description, each participant wishing to play against the dealer places an initial "ante" bet on a space on the game design overlay.

Once all parties have anted up, the dealer begins to distribute a shuffled deck of cards clockwise or counterclockwise to each individual, one card at a time, face down, until a total of two revolutions have taken place—with the dealer also receiving one card, face down, during each revolution. As with 3 card poker, one additional card will be dealt to each player, but with the player, according to the invention, being able to decline to bet on that third card if so desired. Because a third card could give each player the possibility of having "three of a kind", "a straight" of consecutively numbered cards, "a flush" of three cards of the same suit, or "a straight flush" of three consecutive cards of the same suit, each player will have the ability to place an additional wager beyond the initial ante bet before being dealt the third card. Such a decision to make a further bet is made by placing added chips on individual spaces also provided on the game design overlay, where the odds offered by the casino are displayed as well. Those players whose first two cards do not offer the possibility of obtaining such poker hands may have the opportunity of placing an additional bet that the third card dealt may offer them a hand whose point total is "low" (i.e., adding the value of each card and utilizing only the "ones" digit totals 0 to 4), or betting a "high" (i.e., adding the values gives a "ones" digit of between 5 and 9). Other type bets could be had as well, for example, that the third card dealt would provide a single pair along with a ten, jack, queen or king,—and, as previously mentioned, the player may elect not to bet on the third card at all. Each bet made would continue to have its own space displayed on the design layout, along with the odds offered by the casino if that bet were made.

Once all further bets are placed, a third card is dealt. This may be done by dealing a third card to each player in turn face down, who then reveal their three cards—or having them first reveal their two cards and dealing the third card face up. This allows the dealer to determine whether or not any of the additional bets wagered have been won or not. Preferably at that time, or later after all of the hands are completely played out, any appropriate monies won on those added bets will be paid by the dealer to the player based on the displayed casino odds, and any additionally wagered bets lost will be collected by the dealer. In such respect, the combination game of the invention exhibits attributes of poker.

The dealer then reveals his/her two cards, enabling the players to view what the dealer is holding. The dealer then draws a third card face up—and like the other players, adds up the values to determine which hands came closer to "nine". For each player hand closer to "nine", the player wins the initial ante bet; for each player hand further from "nine" than the dealer's, the dealer wins the ante bet. In this respect, the combined game resembles that of baccarat—and offers the further advantage that a player who elects not to bet further on the third dealt card can continue in the game, rooting against the dealer's draw in attempting to win the initial ante bet placed. As previously mentioned, in this phase of the game, aces count as "one", tens, jacks, queens and kings count as "zero"—and the "ones" digit of the total value, is used in determining which hands are closest to "nine".

In other versions of the game, options of play could be provided in the event the two cards first drawn by the dealer total eight or nine when added, allowing the dealer to stand pat. Likewise, options could be provided to the player to stand pat when his/her first two cards total eight or nine, as well. A further option could be provided the player of selecting the third card to beat the dealer's hand, as in conventional poker.

As will be readily apparent, if the baccarat aspect of the game is sought to be combined, instead, with a 4 card rather than a 3 card poker playing arrangement, additional table layout spaces could be provided to cover such additional bets as "two pair", "four of a kind", and three of a kind along with a ten, jack, queen or king. Again, the odds for paying off such bets will be displayed on the design overlay.

Other gambling bets—such as tieing the dealer on the ante bet—could be afforded and set out on the overlay as well.

BRIEF DESCRIPTION OF THE DRAWINGS

These and other features of the present invention will be more clearly understood from a consideration of the following description taken in connection with the accompanying drawings in which:

FIG. 1 is a pictorial view of a table layout design helpful in an understanding of the set up of the game;

FIGS. 2–5 are combined pictorial views and flow charts indicating how in the combined 3 card poker-baccarat card playing game one shuffled hand may be played according to the invention;

DETAILED DESCRIPTION OF THE INVENTION

Figure 2:
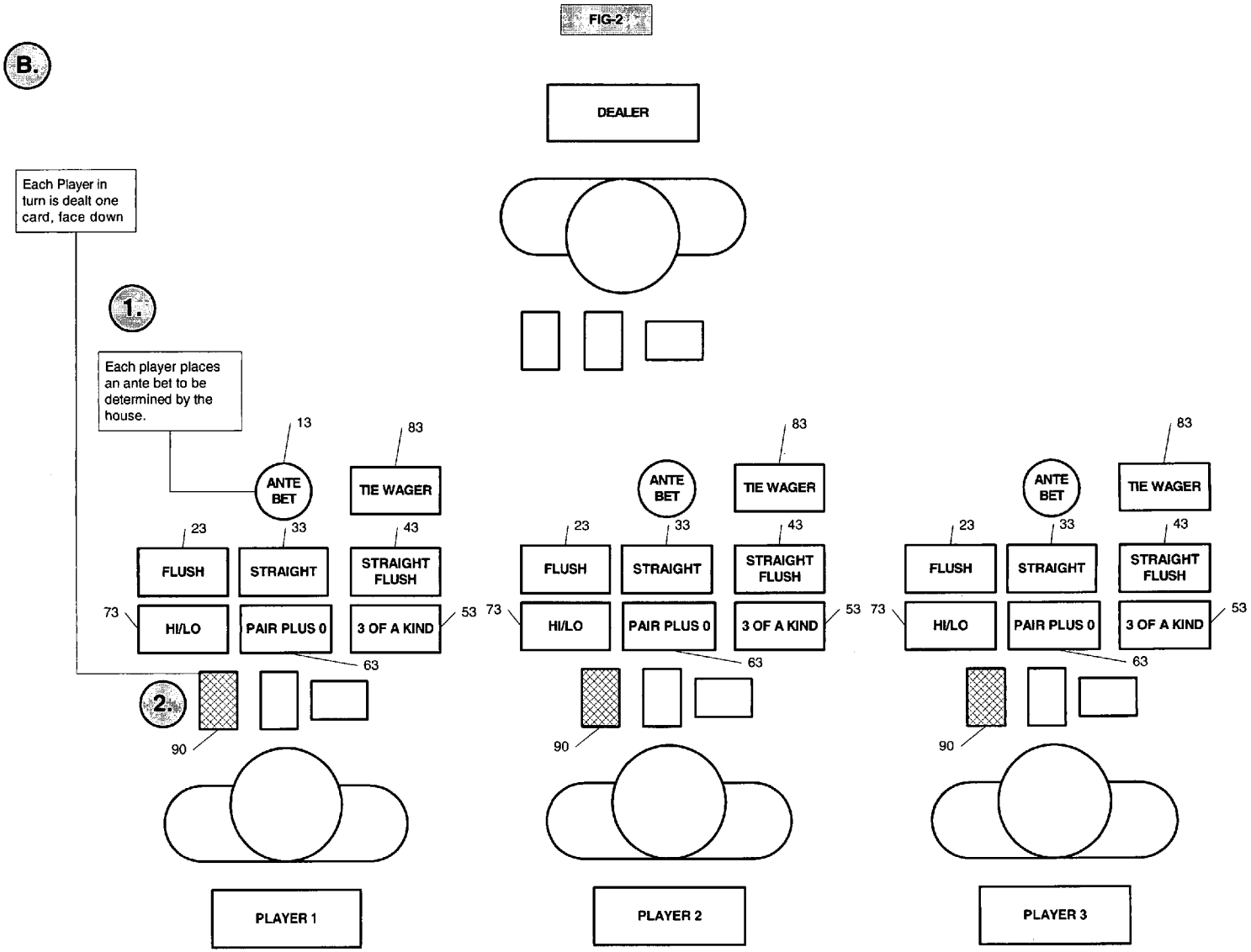
Figure 3:
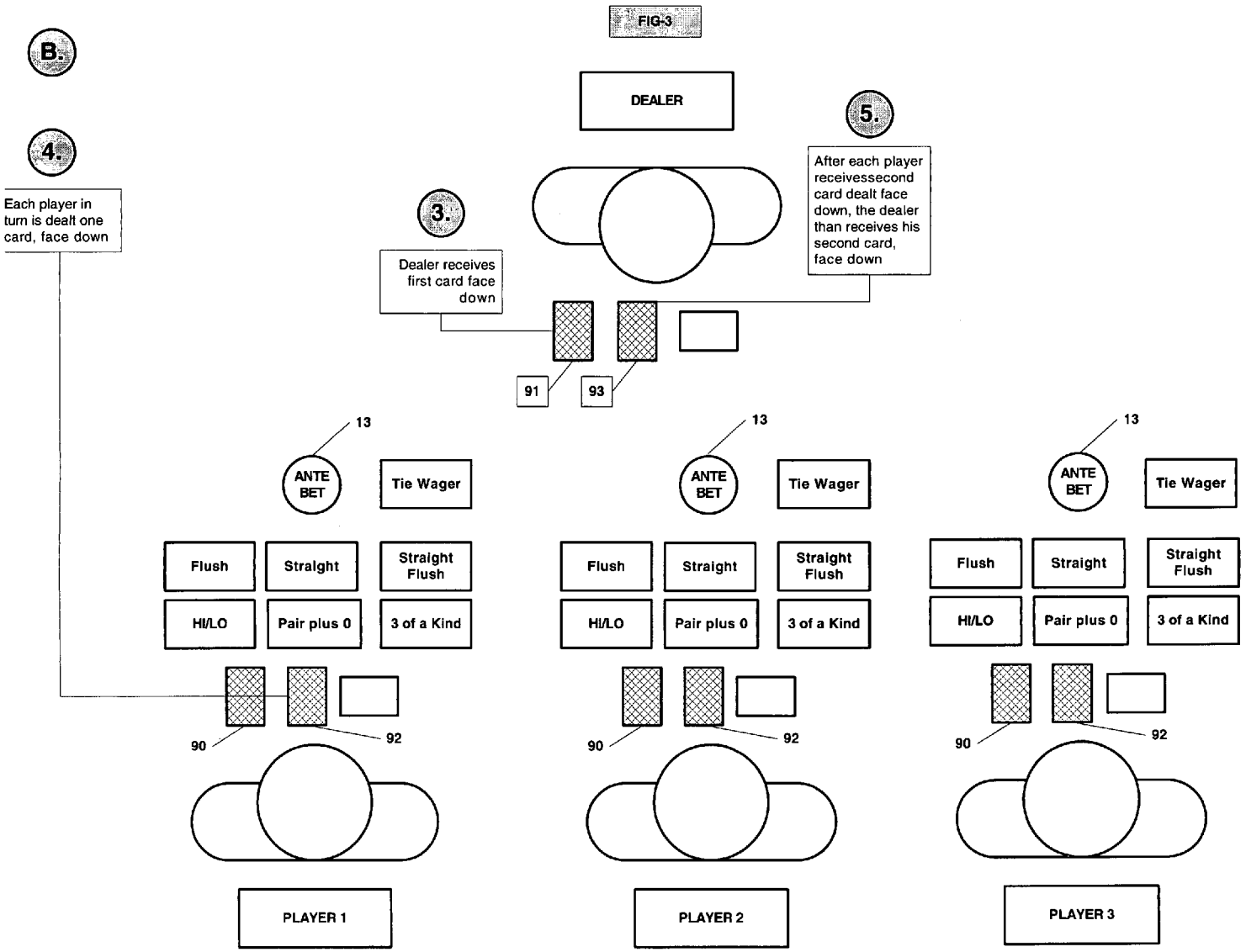

In FIG. 1, A1 illustrates a dealer position for three playing card placements 10, 11, 12 for the 3 card poker aspect of the game. A2 illustrates a player position with three playing card placements 20, 21, 22 and an initial ante bet wager placement 13 for joining in the game. Seven betting placements 23, 33, 43, 53, 63, 73 and 83 are illustrated. In the 3 card poker-baccarat combined game, "flush", "straight", "straight flush" and "3 of a kind" possibilities are apparent, as represented at placements 23, 33, 43 and 53, respectively. Three additional betting placements are shown for "pair plus 0" 63 (i.e., for a pair plus a ten, jack, queen or king), for high/low 73 (i.e., the "ones" digit after totalling the three cards dealt being five, six, seven, eight or nine for a "high", and zero, one, two, three or four for "low"), and for a "tie" with the dealer on the ante bet 83.

As illustrated, the first two cards dealt to the player A2 are assumed to be an eight of diamonds and a nine of diamonds, giving the player an option of betting that the third card dealt would give him/her any or all of a "flush" (three diamonds), a "straight" (being dealt a seven or a ten), or a "straight flush" (being dealt a six of diamonds or a ten of diamonds). Using the "ones" digit after adding the eight and nine to give a "seven", the player may also bet that the next card dealt would give him/her a total of 5 to 9 for a "high", or a 0 to 4 for a "low". Upon dealing the third card, the dealer can determine whether any or all of these "flush", "straight", "straight flush" or "high/low" bets were made, paying off on those that were made at the predetermined casino odds displayed for each such bet. Those bets that weren't made are collected by the dealer.

FIGS. 2–5 illustrate a possible game being played by three participants, each of whom has placed their initial ante bet at table layout location 13 (B1). Each player is then dealt one card face down, in turn, either clockwise, or counterclockwise, the face down card being shown at 90 (B2 in FIG. 2). The dealer then draws its first card face down 91 (B3 in FIG. 3). Each player is then dealt a second card face down 92 (B4 in FIG. 3). The dealer then draws its second card face down 93 (B5 in FIG. 3).

As FIG. 4 next illustrates, each player after viewing their two cards has the option to choose further bets depending upon their holdings—for example, the seven wagers of FIG. 1 as 23, 33, 43, 53, 63, 73 and/or 83 (B6). If they so desire, each player then places the appropriate chip wager or wagers into the respective display space corresponding to the make-up of their hand (B7). In the example of FIG. 4, the cards 90 and 92 for Player 1 are shown for understanding as a nine of diamonds and a ten of diamonds; those cards 90 and 92 for Player 2 are shown as a jack of diamonds and a jack of hearts; those for Player 3 are shown as a six of hearts and a six of clubs. Player 1, having a nine of diamonds and ten of diamonds, opts to wager the third card will give a straight and a straight flush (100), and places appropriate bets of whatever chip amount at layout locations 33 and 43. Player 2, having a jack of diamonds and jack of hearts, opts to wager that the third card would result in a pair plus a ten, jack, queen or king and places a bet in layout location 63. Additionally wagering that the third card would also be a jack, Player 2 places an additional bet in location 53 for three of a kind. Player 2 might place a further bet that he and the dealer would tie on the ante bet—all as shown at 101. Player 3 similarly may wager a third card being a six of spades or six of diamonds to get three of a kind, or that it would be a ten, jack, queen or king to yield a pair plus "0" (102)—and places additional bets of whatever chip amount desired in accordance with casino rules on the layout locations of 53 and 63.

In FIG. 5, after all bets have been placed, each player and the dealer reveals the first two cards and the players are dealt a third card, face up (B8). At that point, each of Players 1, 2 and 3 and the dealer will know whether the respective wagers have been won or not. With Player 1 receiving a third card 94 of a jack of diamonds, Player 1 wins the "straight" and "straight flush" wagers and is paid then or at the completion of the hand the bet multiplied by the house odds displayed on the layout. Player 2 draws a queen of spades as its third card 94 and thus loses its "three of a kind" bet but wins its "pair plus 0" bet (all face cards have a value of "zero"). Player 3 is dealt a two of diamonds as its third card 94, and thus loses its "three of a kind" bet and its "pair plus 0" bet as well.

This essentially ends the three card poker aspect of the combined game of the invention, with the understanding that a player does not have to make any of these additional wagers as to "flush", "straight", "straight flush", "three of a kind", or "pair plus 0"—bets, depending on the first two cards received (as where a three of hearts and a queen of clubs are dealt). Such player, however, may continue in betting the third card will yield a "high" or a "low"—but, in any event, continues to be in the game with respect to the initial ante bet placed. Each player is able to vocally "urge on" the third card to be dealt for their respective bets, giving the game the attribute of "craps" in this respect.

The baccarat aspect of the combined game then comes into play. Thus, as B9 of FIG. 5 illustrates, the dealer then draws its third card 95—with the players rooting against him/her—giving the dealer a two of diamonds to go along with its previously drawn seven of clubs 91 and king of hearts 93. Totalling the dealer's three cards and using only the "ones" digit gives to the dealer a "nine", a baccarat winning hand. This ties the value of Player 1's hand and Player 1's ante bet at 13 is a draw. Player 2's three card total is a "zero", so that Player 2 loses its ante bet. Player 3's hand totals "four" (six+six+two=fourteen=four), so that Player 3 loses its ante bet as well. Had Player 1 placed a bet in layout space 83 that there would have been a tie with the dealer, then Player 1 would have won its ante bet. In accordance with the invention, an additional wager possibility could be had, that the player's hand after being dealt all three cards would be of a greater poker value than that of the dealer—and a space provided for that on the layout overlay. In the illustration of FIG. 4, any of Players 1, 2 or 3 would have won such wager, as the dealer only showed "king high".

Figure 6:
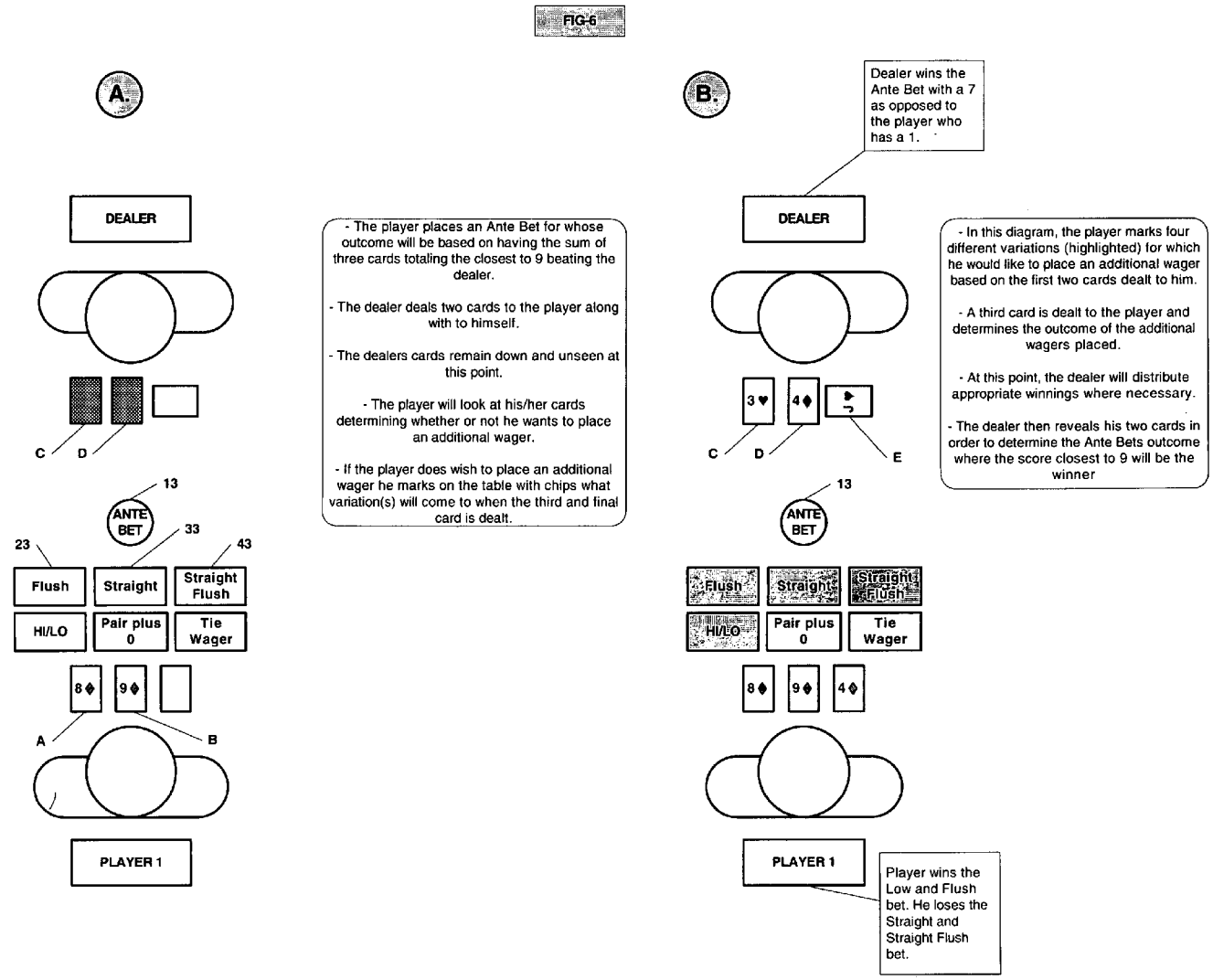
FIG. 6 is a further combined view of a playing layout and flow chart helpful in an understanding of the invention.

In a summarization of the invention as shown in FIG. 6—referring to the game fancifully by the name "TO THE 9's" (the winning total for baccarat)—the player places an ante bet whose outcome is based on having the sum of three cards totalling closer to nine, and beating the dealer. The dealer deals two cards A and B face down to the player along with two cards C and D face down to himself. With the dealer cards remaining face down, the player looks at his/her cards determining whether or not he/she wishes to place an additional wager. If the player wishes to place an additional wager, that wager is marked on the table with chips hoping for the result that will come when the third card is dealt. With the player's cards being an eight of diamonds and a nine of diamonds, for example, the player can select four additional bets—a "flush" hoping to draw another diamond, a "straight" hoping to draw a six or a ten, a "straight flush" hoping that the third card is either a six of diamonds or a ten of diamonds, and a "low" hoping that the third card adds to the "seven" of the first two cards to provide a total value of 0 to 4. With the player's third card being a four of diamonds, the outcome of the further wagers is determined and the dealer may pay off preferably then the player's bets according to the table odds—paying off for the "flush", collecting for the "straight", collecting for the "straight flush", and paying off for the "low" (as the three cards add up to a "one"; eight+nine+four=twenty one=one). The dealer then reveals its two cards, a three of hearts and a four of diamonds, draws its third card a jack of hearts to total "seven" (three+four+zero=seven). The dealer thus wins the ante bet 13 as its hand of "seven" comes closer to "nine" than the player's "one". If an additional bet for the better poker hand were available and made, the player would have won that also.

Figure 7:
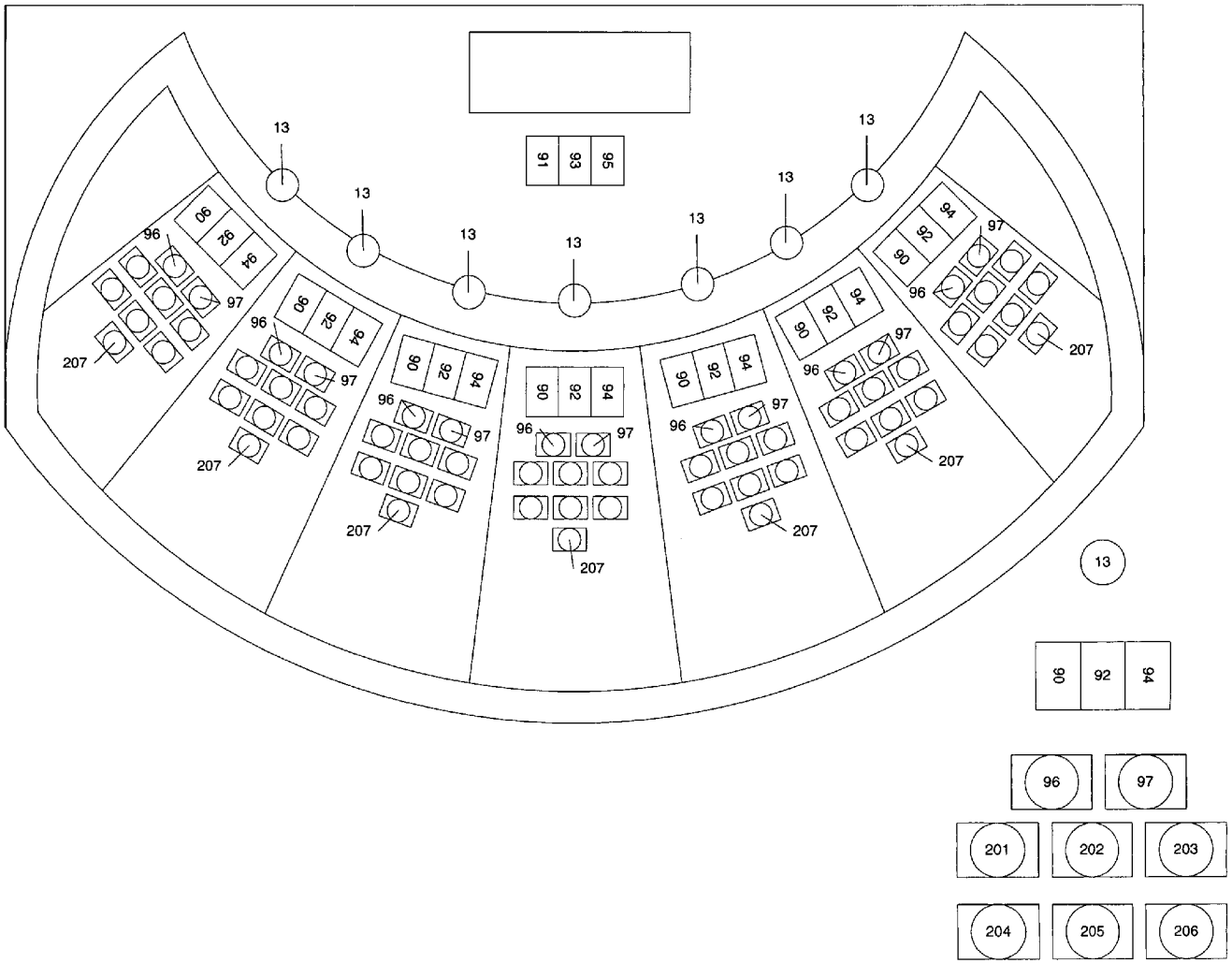
FIG. 7 illustrates a type of gaming table layout for seven participating players.

FIG. 7 shows a possible layout for up to seven participants playing the combined game of the invention at any one time. Reference numeral 13 represents the space for the initial ante bet for each player. Reference numerals 90, 92 and 94 represent the card placement positions for the players while 91, 93 and 95 represent the card placement positions for the dealer. Reference numerals 96 and 97 are the spaces for betting "high" and "low" values for the three card totals respectively, as 5 to 9 and 0 to 4. Reference numerals 201, 202 and 203 represent betting spaces for the "flush", "straight" and "straight flush" wagers. Reference notations 204, 205 and 206 represent the betting locations for the "pair plus 0", "three of a kind" and "tie wager" bets. If a further bet for the player having a poker hand greater than the dealer's is to be provided, that might be shown as 207—and other betting locations could be provided if the casino sets up other wagers to be made (or if the layout is also to be used for a combined game of baccarat with a 4 card poker layout). In any event, the casino odds for successfully winning any of the bets will be displayed on the layout, as with a conventional craps table design.

As previously mentioned, a player not being dealt a promising poker hand with the first two cards can elect to proceed with no further additional wagering. The player will, however, continue to root for his/her third card dealt giving a baccarat hand close to "nine", and to vocally bet against the dealer's third card in hoping to win the ante bet. Obviously, those players making further wagers still cheer on their third cards to win their additional bets, and against the dealer's third card in getting closer to "nine", to win the ante bet as well. In these respects, a livelier, more enjoyable game is had, with added betting options for all players.

While there have been described what are considered to be preferred embodiments of the present invention, it will be readily appreciated that modifications can be made by those skilled in the art without departing from the scope of the teachings herein. For example, each of the cards dealt or drawn, the determining of the poker bets won or lost, and the totalling of the digit values for baccarat could all be carried out electronically and displayed on a video screen, and the excitement of the combined game still be had. For at least such reason, therefore, resort should be had to the claims appended hereto for a true understanding of the scope of the invention.

We claim:

1. A method of playing a casino gambling card game comprising the steps of:

a player placing a predetermined initial ante bet to participate in the game;

a dealer dealing at least two playing cards from a deck to the player;

the player placing a second bet that a next card dealt by the dealer would give the player a poker hand of one of a straight, a flush and straight flush for the total number of cards dealt;

the dealer dealing the player said next card;

the dealer drawing a like number of cards to itself;

ascribing to the cards dealt to the player and the cards drawn by the dealer a baccarat value of "one" for each ace, a value of "zero" for each ten, jack, queen and king, and the point face value of each other card;

totalling the baccarat value of all cards received by the player;

totalling the baccarat value of all cards drawn by the dealer;

comparing the "ones" digit of said total value of cards received by the player with the "ones" digit of said total value of cards drawn by the dealer for itself; and awarding the winning of said ante bet to the player or dealer whose baccarat "ones" digit total comes closer to "nine".

2. The method of claim 1 wherein the dealing of each card but said next card to the player, and the drawing of each card but the last by the dealer is done face-down.

3. The method of claim 2 wherein said second bet is won by the player when the next card dealt provides the player with a poker hand of at least one of a straight, flush and straight flush.

4. The method of claim 2 wherein said player places individual ones of multiple bets that the next card dealt by the dealer would give the player a poker hand inclusive of a straight, a flush and a straight flush.

5. The method of claim 2 wherein said dealer deals three playing cards to the player and wherein said player places individual ones of multiple bets that the next card dealt by the dealer would give the player a poker hand inclusive of three of a kind, a straight, a flush and a straight flush.

6. The method of claim 5 wherein said player also places individual ones of multiple bets that the next card dealt by the dealer would give the player a poker band of a single pair together with a ten, jack, queen or king, a "ones" digit total of 0 to 4, and a "ones" digit total of 5 to 9.

7. The method of claim 5 wherein said three playing cards are dealt to the player and drawn by the dealer from a fifty two card deck.

8. The method of claim 2 wherein said dealer deals four playing cards to the player and wherein said player places individual ones of multiple bets that the next card dealt by the dealer would give the player a poker hand inclusive of two pair, three of a kind, four of a kind, a straight, a flush and a straight flush.

9. The method of claim 8 wherein said player also places individual ones of multiple bets that the next card dealt by the dealer would give the player a poker hand of a three of a kind together with a ten, jack, queen or king, a "ones" digit total of 0 to 4, and a "ones" digit total of 5 to 9.

10. The method of claim 8 wherein said four playing cards are dealt to the player and drawn by the dealer from a fifty two card deck.

11. The method of claim 1 wherein each individual step is carried out electronically, and displayed on a video screen.

12. The method of claim 1 wherein the dealing of each playing card to the player precedes in turn the drawing of each playing card by the dealer.

13. The method of claim 12 wherein each individual step is carried out electronically and displayed on a video screen.

14. A method of playing a casino gambling card game comprising the steps of:

a player placing a predetermined initial ante bet to participate in the game;

a dealer dealing at least two playing cards from a deck to the player;

a player determining from the two playing cards dealt whether to continue to participate in a poker aspect of the casino gambling card game, and it so, the player placing a second bet that a next card dealt by the dealer would give the player a poker hand of one of a straight, a flush and straight flush for the total number of cards dealt;

the dealer dealing the player said next card;

the dealer drawing a like number of cards to itself;

ascribing to the cards dealt to the player and the cards drawn by the dealer a baccarat value of "one" for each ace, a value of "zero" for each ten, jack, queen and king, and the point face value of each other card;

totalling the baccarat value of all cards received by the player;

totalling the baccarat value of all cards drawn by the dealer;

comparing the "ones" digit of said total value of cards received by the player with the "ones" digit of said total value of cards drawn by the dealer for itself;

awarding the winning of said ante bet to the player or dealer whose baccarat "ones" digit total comes closer to "nine"; and awarding the winning of said second bet to the player whose next card is the straight, flush or straight flush bet upon, otherwise awarding such second bet to the dealer;

with the player forfeiting said initial ante bet upon determining not to participate in said poker aspect of the game by not placing said second bet and continuing no further.

15. The method of claim 14 wherein the dealing of each card but said next card to the player, and the drawing of each card but the last by the dealer is done face-down.

16. The method of claim 14 wherein said dealer deals two playing cards to the player and wherein said player places individual ones of multiple bets that the next card dealt by the dealer would give the player a poker hand of either three of a kind, a straight, a flush and a straight flush.

17. The method of claim 16 wherein said player also places individual ones of multiple bets that the next card dealt by the dealer would give the player a poker hand of a single pair together with a ten, lack, queen or king, a baccarat "ones" digit total of 0 to 4, and a baccarat "ones" digit total of 5 to 9.

* * * * *